US006494214B1

(12) United States Patent
Coldicott

(10) Patent No.: US 6,494,214 B1
(45) Date of Patent: Dec. 17, 2002

(54) DEVICES AND METHODS OF HAIR GROOMING

(75) Inventor: Graham Coldicott, New South Wales (AU)

(73) Assignee: Freestyla Pty Ltd., North Sydney (AU)

( * ) Notice: Subject to any disclaimer, the term of this patent is extended or adjusted under 35 U.S.C. 154(b) by 0 days.

(21) Appl. No.: 09/763,563

(22) PCT Filed: Aug. 5, 1999

(86) PCT No.: PCT/AU99/00635

§ 371 (c)(1),
(2), (4) Date: May 17, 2001

(87) PCT Pub. No.: WO00/10420

PCT Pub. Date: Mar. 2, 2000

(30) Foreign Application Priority Data

Aug. 24, 1998 (AU) ..... PP5432

(51) Int. Cl.[7] ..... A45D 24/34; A45D 24/38; A45D 24/00

(52) U.S. Cl. ..... 132/213.1; 132/145; 132/148

(58) Field of Search ..... 132/213.1, 213, 132/214, 144, 145, 148, 207, 277, 278, 273, 275, 276, 279

(56) References Cited

U.S. PATENT DOCUMENTS

| | | | | |
|---|---|---|---|---|
| 1,813,423 A | | 7/1931 | Richard et al. | |
| 3,841,340 A | * | 10/1974 | Solomon | 132/213 |
| 4,414,991 A | | 11/1983 | Marcotte | |
| 4,753,252 A | * | 6/1988 | Boxer | 132/278 |
| 5,012,830 A | | 5/1991 | Vaccaro et al. | |
| 5,427,122 A | | 6/1995 | Hamilton | |
| 5,816,267 A | | 10/1998 | Chou | |
| 6,135,123 A | * | 10/2000 | Grassi et al. | 132/213 |
| 6,267,119 B1 | * | 7/2001 | Silva | 132/213 |

FOREIGN PATENT DOCUMENTS

| | | |
|---|---|---|
| DE | 154350 | 7/1932 |
| EP | 0728425 A1 | 5/1996 |
| GB | 313469 | 6/1929 |
| GB | 522445 | 6/1940 |
| GB | 2168251 A | 6/1996 |
| GB | 2326591 A | 12/1998 |
| JP | 08173232 A | 7/1996 |

* cited by examiner

*Primary Examiner*—John J. Wilson
*Assistant Examiner*—Robyn Kieu Doan
(74) *Attorney, Agent, or Firm*—Carol M. LaSalle; Bozicevic, Field & Francis LLP

(57) ABSTRACT

A hair grooming device, in particular a device that facilitates the cutting and styling of hair at home, as well as at the salon. The device has handle with one or more fingers extending from it. The fingers may be curved to conform to the shape of the head. At least one of the fingers has a slot extending along its length. A comb carrying teeth extends adjacent the length of the/each slotted finger and is moveable between a retracted position in which it is spaced apart from the slot, and an engaged position in which the teeth intersect the slot to grip hair along the length of the slotted finger. A method of using the device is a further aspect of the invention.

33 Claims, 5 Drawing Sheets

DEVICES AND METHODS OF HAIR GROOMING

TECHNICAL FIELD

This invention concerns hair grooming devices, and in particular devices that facilitate the cutting and styling of hair at home, as well as in the salon. In a further aspect the invention is a method of using the devices.

BACKGROUND ART

Barbers and hairdressers have used simple scissors and combs for mans years to cut and style hair. For some short haircuts it has been possible to use electric shears, and there are many attachments available for the shears to control the length and profile of the cut. Nevertheless, apart from the simplest cuts it has been difficult for people to cut and style their own hair, because of the skill required to achieve a good result.

SUMMARY OF THE INVENTION

The invention is a hair grooming device having a handle with one or more fingers extending from it. The fingers may be curved to conform to the shape of the head, and a circular arc has been found to be suitable for this purpose. At least one of the fingers has a slot extending along its length. A comb carrying teeth extends adjacent the length of the, or each, slotted finger and is moveable relative to the adjacent slotted finger between a retracted position in which it is spaced apart from the slot, and an engaged position in which the teeth intersect the slot to grip hair along the length of the slotted finger. It should be appreciated that the slot may be open, that is an aperture that passes entirely through the finger, or closed, that is a groove in the surface of the finger, and that both types of slot may operate in the same way.

In use, the device is manipulated so that the finger, or fingers, are positioned in the hair with the comb, or combs, retracted so that hair enters the space between the comb and the finger. When the device is in the desired location, the comb is moved to grip hair along the length of the finger. The device is then manipulated to comb through the hair until it defines the line along which the hair is to be cut. Scissors or shears may then be used to cut the hair along a surface of the finger.

The combs may be spring biased into either the extended or retracted positions. Manipulation of the device may then cause the combs to be temporarily moved out of the biased position.

The finger or fingers may be run along the scalp and then the comb is engaged before the hair is lifted and cut, so that a complete layer of hair is cut at one time. The finger or fingers may also be run along the scalp and then the comb is engaged before the device is tilted about the point were the fingers meet the handle, to enable a complete layer to be cut along an angle.

In one example there is a single slotted finger. The comb and slotted finger are pivotally connected to each other at their bases where they meet the handle. The comb is operable to move towards and away from the finger. When the comb is moved towards the finger the teeth enter the slot. The comb may be slid into the hair and then manipulated to grip the hair with the desired pressure and to accommodate different volumes of hair captured between the comb and finger. In this device the comb may be biased into the extended position where it resides in the slot.

The slotted finger may have an open slot, and a further finger may lie below the slotted finger. The further finger may have a closed slot, or groove, in its upper surface. The teeth of the comb may pass through the open slot and into the slot or groove of the further finger when it is moved to the engaged position.

Once the hair is engaged in the teeth of the comb, the device is moved through the hair until it defines the end shape, such as the shape of the fringe, side of the face, or nape of the neck. The hair is then cut using scissors or shears.

In another example there are several slotted fingers arranged side by side. The fingers are closely spaced, but may be flexible so they can be combed through the hair. In this example there are slots in the fingers that are aligned with each other, and combs are arranged inside the slots. In this example the combs are operable to move out of the slots so that the teeth extend into a slot in an adjacent finger. In this example the combs may be biased into the extended position where they enter the adjacent slots.

This example of the device may be slid into the hair along the scalp before the combs are engaged. The device may then be lifted or tilted before layers are cut into the hair using scissors or shears.

The finger, or fingers, may be curved in the plane of its slot, and the teeth of the comb may be coplanar, with the ends of the teeth lying along a curve which matches the curve of the fingers. Alternatively, the back of the comb may be curved so that adjacent teeth are offset from one another, and the finger may be curved so that its slot is curved. The curve could also be more complicated and include curvature in both orthogonal directions mentioned above.

It is a particular advantage of the device that it enables longer hair styles to be cut with shears or hair clippers.

BRIEF DESCRIPTION OF THE DRAWINGS

An example of the invention will now be described with reference to the drawings, in which.

BEST MODES FOR CARRYING OUT THE INVENTION

Figure 1:
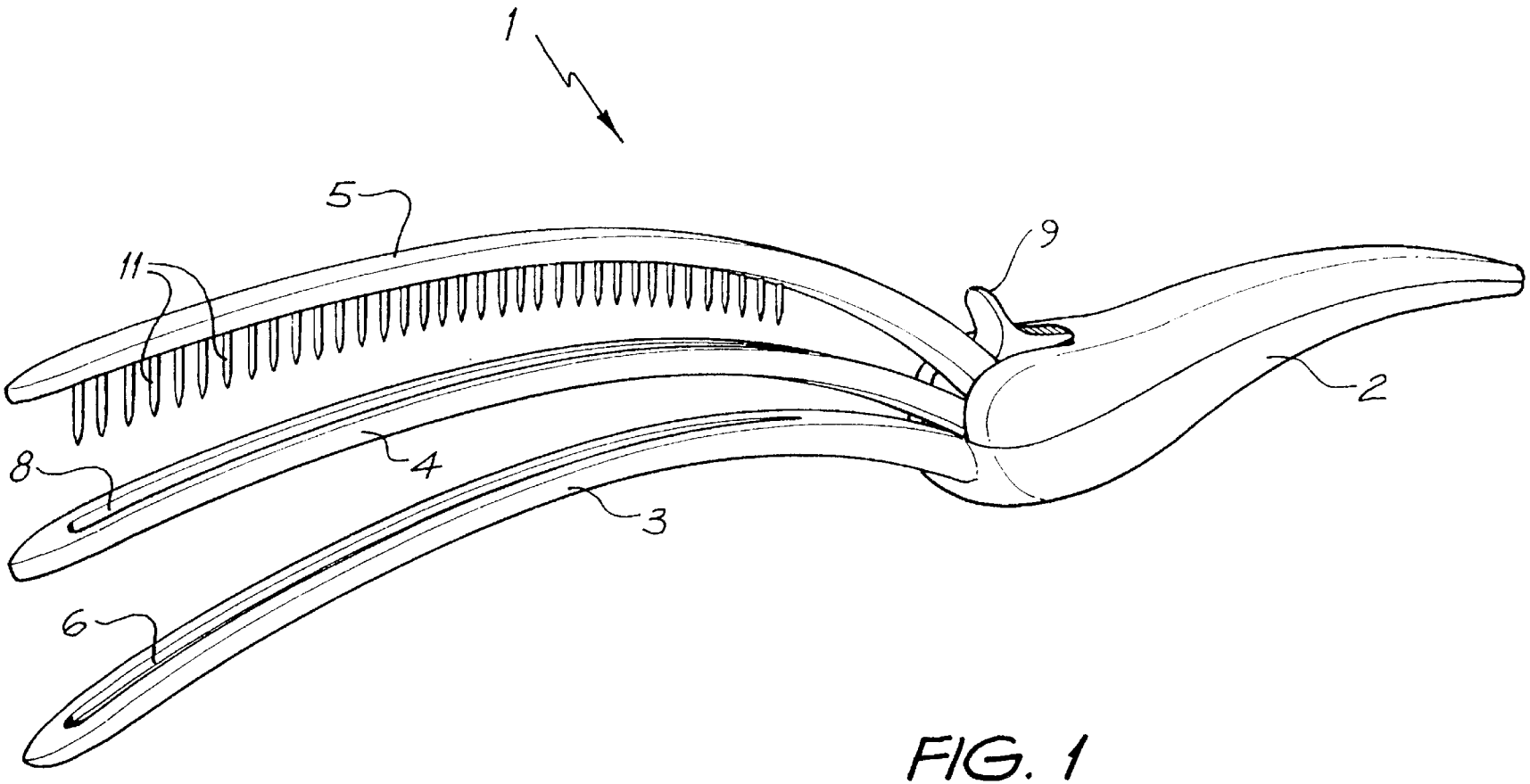
FIG. 1 is a pictorial view of a first hair grooming device exemplifying the invention.
Figure 2:
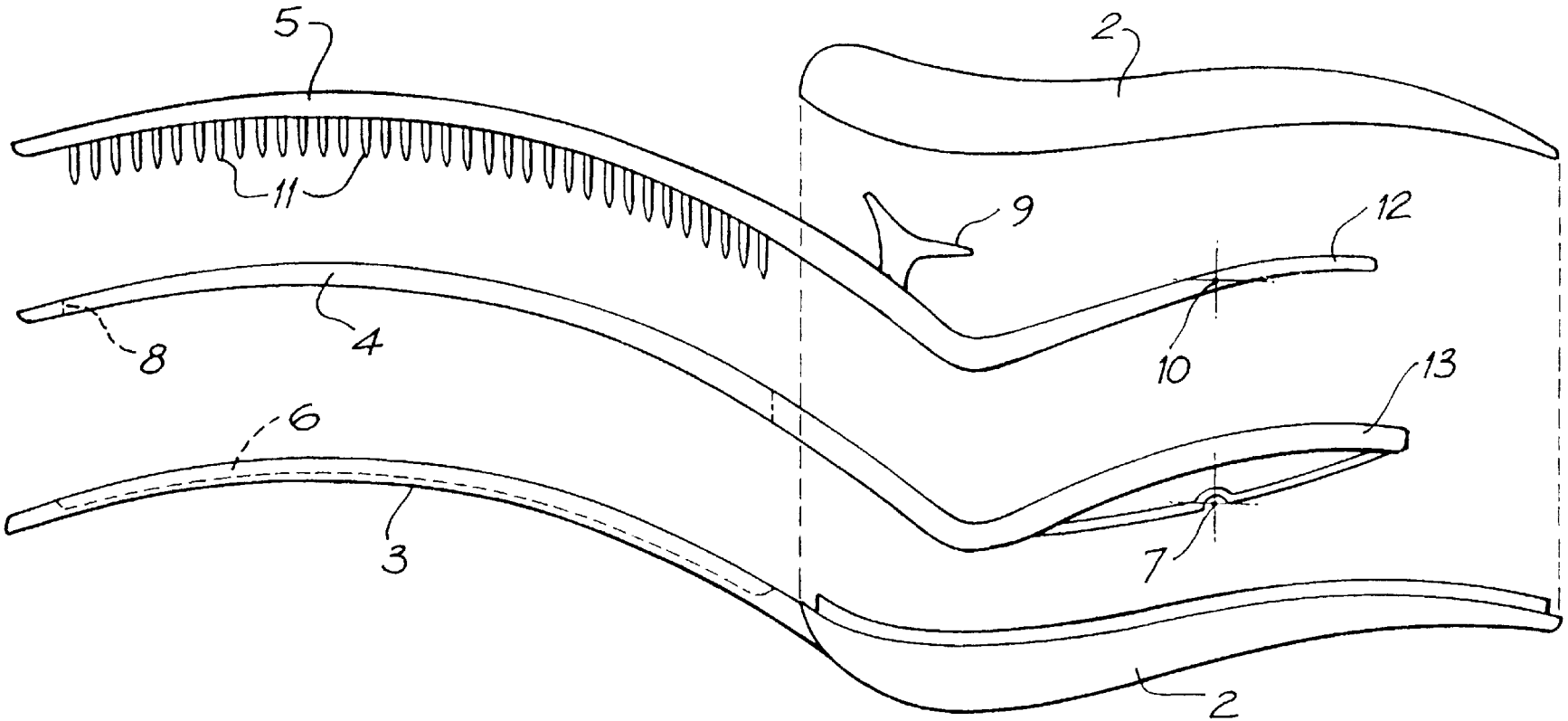
FIG. 2 is an exploded view of the hair grooming device of FIG. 1.
Figure 3:
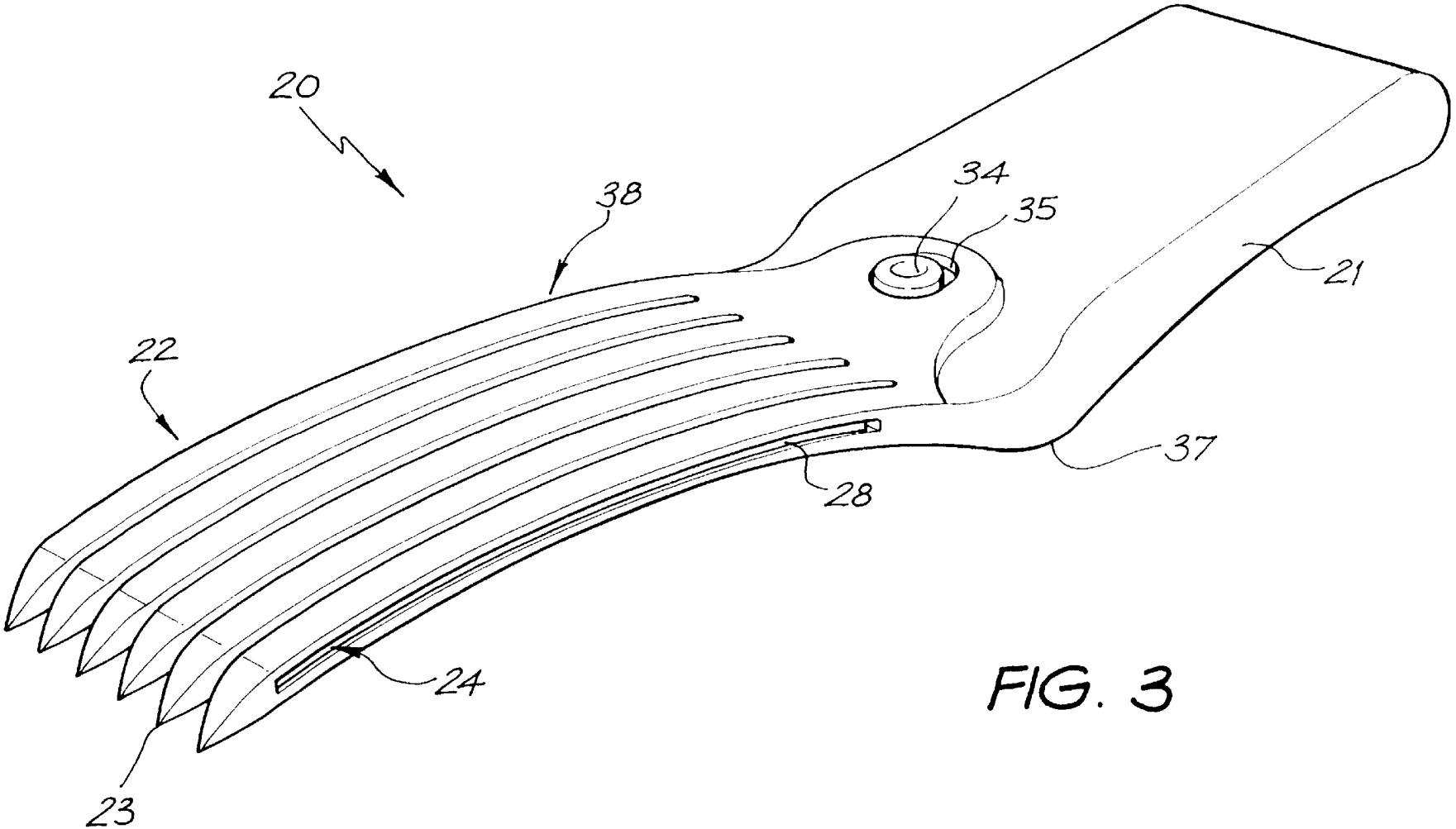
FIG. 3 pictorial view of a second hair grooming device exemplifying the invention.
Figure 4:
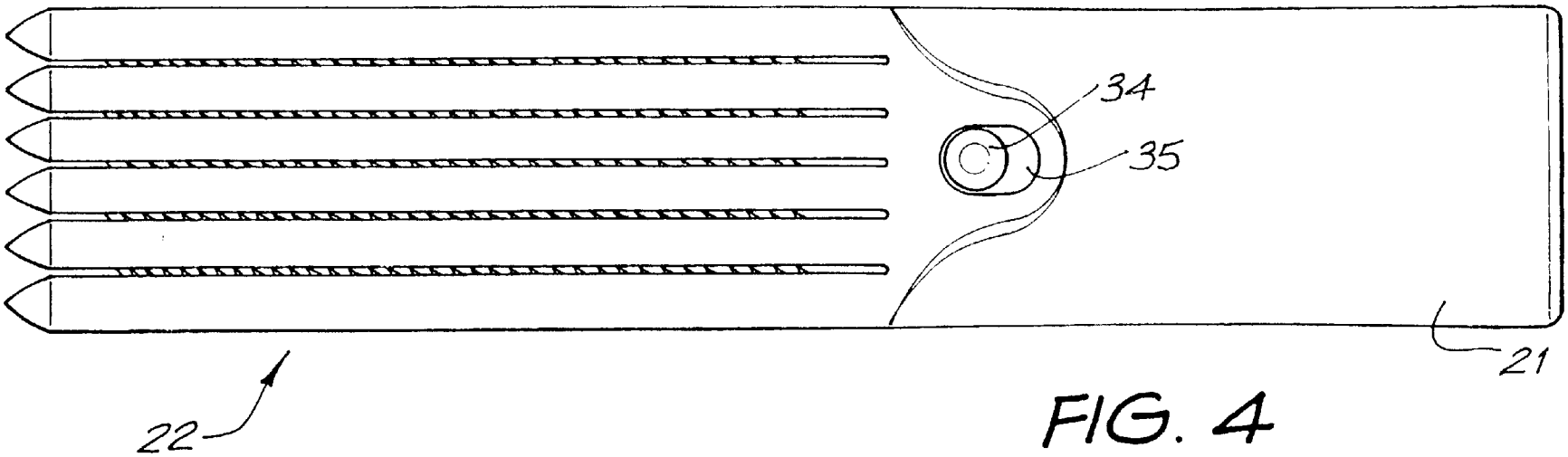
FIG. 4 is a plan view of the hair grooming device of FIG. 3.
Figure 5:
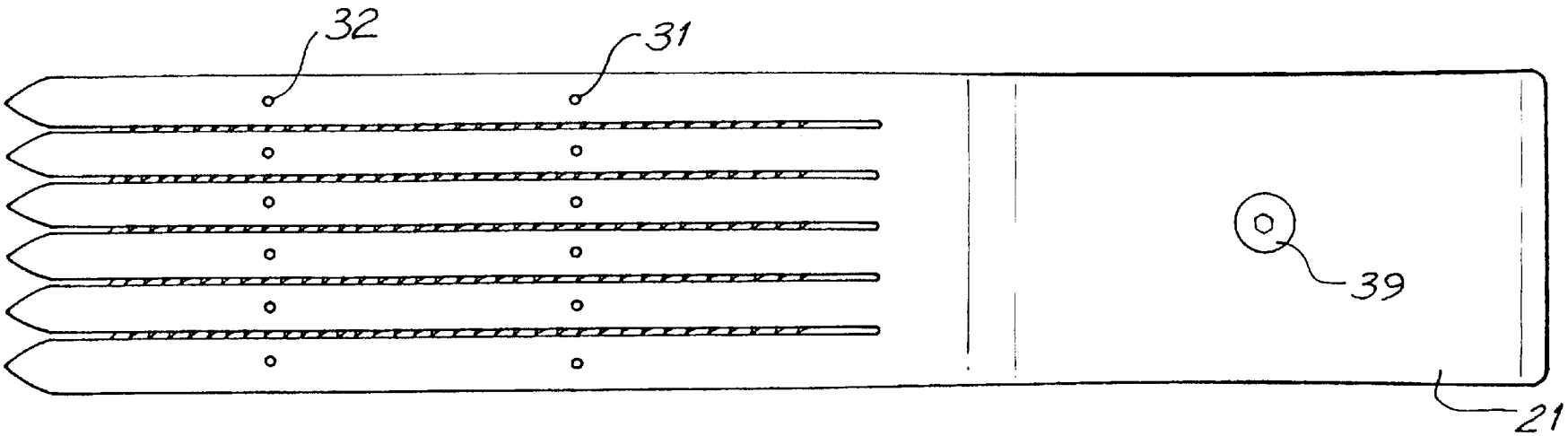
FIG. 5 is a reverse plan view of the hair rooming device of FIG. 3.

Referring first to FIGS. 1 and 2, the first hair grooming device 1 has a handle 2 from one end of which three curved fingers 3, 4 and 5 extend. The three curved fingers 3, 4 and 5 all have the same curvature.

The first curved finger 3 is fixed in position relative to the handle 2. It has a "v" shaped groove 6 running along its upper surface.

The second curved finger 4 is able to rotate through a short arc relative the finger 3, about axis 7. The finger 4 has a vertical slot 8 running along almost its entire length.

The third curved finger 5 is able to be lifted by pulling up on formation 9 and is able to rotate about axis 10, through a larger arc than second finger 4. Third curved finger 5 has a row of teeth 11 running along its lower surface, and can be thought of as a "comb".

When the device is held by handle 2, formation 9 can conveniently be raised by the thumb. Raising formation 9, raises comb 5 but forces down the internal end 12 of finger 5. This in turn forces down the internal end 13 of finger 4 which raises finger 4 so that there is separation between fingers 3, 4 and 5. Pressing down on formation 9 closes all the fingers 3, 4 and 5 together. When closed together the teeth 11 of comb 5 enter slot 8 and the distal ends of the teeth 11 enter the "v" shaped groove 6 in finger 3.

The curvature of all three fingers is in the plane of the slot 8, or put another way, the plane of the teeth 11 of comb 5.

In use the handle 2 is grasped in one hand, and one of the fingers, or the thumb, of that hand may be used to raise and lower the fingers when required. Initially the fingers are not pressed together but are splayed apart as shown in FIG. 1. In this configuration the curved fingers may be pushed into the hair so that hair enters the spaces between the fingers. For instance, the fringe may be combed down onto the forehead, and the first finger 3 may be run across the forehead under the hair so that the fringe enters the spaces between the fingers.

When the curved fingers are positioned in the hair at the desired position, the fingers may be pressed together to capture the hair. The teeth 11 along the comb 5 pass through the hair and grip it in position so that it cannot slide along the length of the fingers. The hair is held gripped in this position, and can be lifted and cut using scissors or shears held in the other hand. The free ends of the hair may be cut closely along the side the device.

Referring now FIGS. 3, 4, 5 and 6, a second device 20 has a wide handle 21 from the front of which extends a row of six curved fingers 22. The fingers have an approximately square section and there is a very, fine gap between each pair of adjacent fingers. Each of the fingers has a pointed end 23 and a slot 24 extending along its length and laterally through it.

Figure 6:
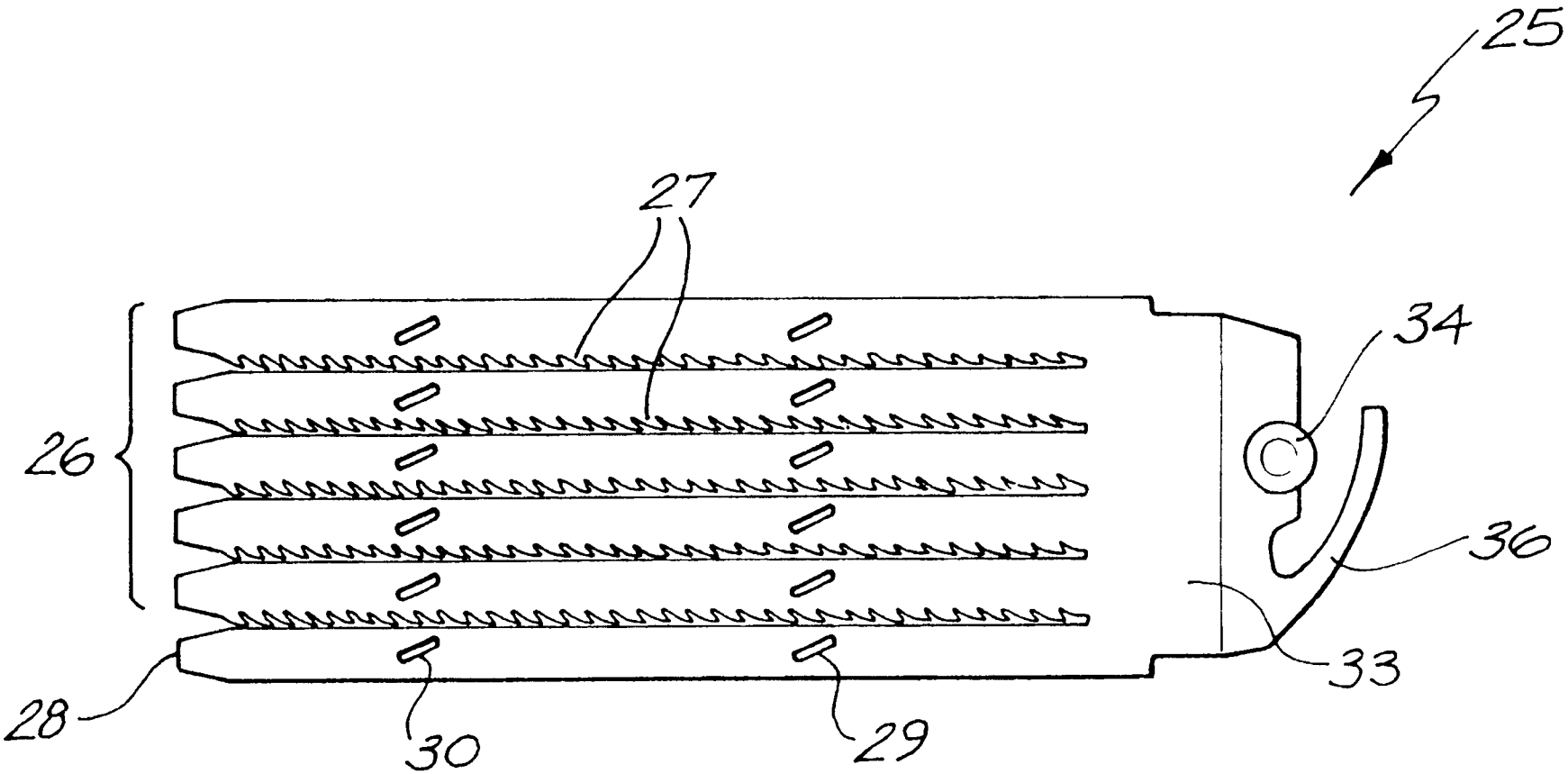
FIG. 6 is a plan view of the comb with the hair grooming device of FIG. 3.

A curved series of combs 25, shown in plan view in FIG. 6, resides inside the device 20. The series of combs 25 comprises five ganged combs 26 having sideways extending teeth 27, and there is a further 'blank' comb 28 without any teeth. Each of the combs 26 and the 'blank' comb 28 resides in a respective slot 24 of the device.

Along the length of each of the combs 26 and 28 there are two diagonally extending slots 29 and 30. Pins 31 and 32 extend from the inside of each of the fingers 22 into the slots 24 and ride in respective diagonal slots 29 and 30 to control the movement of the combs.

The combs are ganged together and interconnected at a union 33. A button 34 extends up from the union 33 and through a shaped aperture 35 on the handle 21. A spring 36 is integrally moulded into the base of the union 33, and acts against the inside of the housing 21 to bias the combs out of their respective fingers.

Movement of the button 34 within the aperture 35 moves the combs in unison back into their slots. When the combs 26 move out of their slots 24 the teeth 27 extend into the back of the slot of the adjacent finger. When button 34 is operated the combs move back into their slots against the action of spring 36. The shape of the diagonal apertures 29 and 30 determines the path of the series of combs 25.

In use, the handle 21 is gripped in one hand and a finger or the thumb may is used to operate the button 33 to retract the combs. The curved fingers 22 may then be run along the scalp. The pointed ends 23 of the fingers 22 part the hair so that it runs into the very fine gaps between the fingers. When the fingers are in the desired position the button 34 is released so that the combs 26 and 28 move out of their slots 24 and the teeth 27 engage the hair. When it is engaged, the hair cannot move along the fingers. The fingers 22 are then lifted. It is then possible to cut the hair along a surface of the fingers with scissors or shears held in the other hand.

The hair may be lifted by lifting the entire device away from the head, or the device may be tilted about the edge at 37 to lift the hair. The hair may be cut closely along the upper surface 38 of the device.

A key 39 is provided in the underside of the device to enable it to be dismantled for cleaning.

Although the invention has been described with reference to the two best examples it should be appreciated that it could be exemplified in other forms and they may be operated in different ways than those described. For instance, the handle may be shaped in any convenient fashion. The finger or fingers may be curved differently, or they may be plastically deformable to enable them to temporarily adopt any desired shape. A favoured arrangement involves the use of a mechanism activated by squeezing the handle to close the fingers together. The combs may be biased either into or out of the fingers either as described or otherwise. The device may also be used in hair colouring processes to define boundaries for the hair colouring.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

What is claimed is:

1. A hair grooming device comprising:

a handle;

a comb extending from said handle and having a length and teeth extending along said length; and first and second fingers extending from said handle and adjacent to said teeth, each said finger having a length and a slot extending along said length for receiving said teeth therein;

wherein said comb, said first finger and said second finger are pivotably connected to each other at said handle and wherein said hair grooming device is operable to move said comb and said fingers between a splayed apart position and an engaged position wherein said first slot is aligned with said second slot to received said teeth.

2. The hair grooming device of claim 1 wherein said lengths of said comb and said first and second fingers, respectively, are similarly curved.

3. The hair grooming device of claim 2 wherein said curved lengths have a curvature in at least one orthogonal direction.

4. The hair grooming device of claim 3 wherein said curved lengths have a curvature in two orthogonal directions.

5. The hair grooming device of claim 2 wherein said curved lengths define a circular arc.

6. The hair grooming device of claim 1 wherein said teeth are coplanar.

7. The hair grooming device of claim 1 wherein said first finger length extends adjacent to said comb length and said second finger length extends adjacent said first finger length and wherein said slot of said first finger is open.

8. The hair grooming device of claim 7 wherein said slot of said second finger is closed thereby defining a groove in a surface adjacent said first finger.

9. The hair grooming device of claim 1 wherein said comb, said first finger and said second finger each have a base whereat they are pivotably connected.

10. The hair grooming device of claim 1 wherein said comb and said fingers are biased in a splayed apart position.

11. The hair grooming device of claim 1 wherein said comb and said fingers are biased in an engaged position.

12. The hair grooming device of claim 1 wherein said device is operable by means of a finger-actuated mechanism associated with said handle.

13. The hair grooming device of claim 1 wherein said comb and said fingers are plastically deformable to a desired shape.

14. A hair grooming device comprising:

a handle;

a plurality of fingers extending from said handle, each said finger having a slot therein wherein said plurality of slots are aligned with each other; and a comb associated with and residing within each said slotted finger, wherein said device is operable to move each said comb laterally with respect to each said associated slotted finger.

15. A hair grooming device comprising:

a handle;

a plurality of fingers extending from said handle in a side-by-side arrangement, each said finger having a length and an open slot extending along said length wherein said open slots are aligned with each other; and a plurality of combs, each said comb of said plurality of combs having teeth extending there from, being associated with a corresponding finger and being movable within said slot of said corresponding finger between a retracted position wherein said teeth are positioned inside said respective slot and an extended position wherein said teeth are positioned at least partially outside said respective slot.

16. The hair grooming device of claim 15 wherein said teeth extend at least partially into the slot of an adjacent finger when said comb is in said extended position.

17. The hair grooming device of claim 15 wherein said plurality of combs are movable in unison.

18. The hair grooming device of claim 15 wherein the movement of each said comb between a retracted position and an extended position defines a diagonal pathway.

19. The hair grooming device of claim 15 wherein said plurality of fingers and said plurality of combs are curved.

20. The hair grooming device of claim 15 wherein said plurality of combs are biased out of said slots.

21. A method of grooming hair, comprising the steps of:

providing the device of claim 1 wherein said comb and said fingers are initially in a splayed apart position;

positioning said device in a desired location wherein hair is positioned between said comb and said fingers;

moving said comb and said fingers into an engaged position thereby capturing said hair; and moving said device along the length of said captured hair until the length of the device defines a line along which the engaged hair is to be groomed.

22. The method of claim 21 further comprising the step of cutting the engaged hair along said line.

23. The method of claim 22 further comprising repeating said steps as desired.

24. The method of claim 22 further comprising the step of lifting said captured hair prior to said step of cutting.

25. The method of claim 24 wherein said step of lifting comprise tilting said device.

26. The method of claim 21 further comprising the step of coloring said engaged hair wherein said line defines a boundary for coloring.

27. The method of claim 21 wherein said step of moving said comb and said fingers into an engaged position further comprises the step of preventing said captured hair from moving in a direction along the lengths of said comb and said fingers.

28. The method of claim 21 wherein said step of positioning said device comprises the step of running said fingers along the scalp from which said hair extends.

29. A method of grooming hair, comprising the steps of:

providing the device of claim 15 wherein said combs are initially in retracted positions;

positioning said device in a desired location wherein hair is positioned between said fingers;

moving said combs into extended positions thereby capturing said hair; and moving said device along the length of said captured hair until the length of said device defines a line along which the captured hair is to be groomed.

30. The method of claim 29 further comprising the step of cutting the engaged hair along said line.

31. The method of claim 30 further comprising repeating said steps as desired.

32. The method of claim 30 wherein said step of moving said combs into an extended position further comprises the step of preventing said captured hair from moving in a direction along the length, of said combs and said fingers.

33. A hair grooming device comprising:

a handle;

a comb extending from said handle and having a length and teeth extending along said length;

a first finger extending from said handle and adjacent to said comb, said first finger having a length and an open slot extending along said length for receiving said teeth therein; and a second finger extending from said handle and adjacent to said first finger, said second finger having a length and a closed groove along said length for receiving said teeth therein;

wherein said device is operable to move said fingers relative to each other between a retracted position, in which said comb and said fingers are splayed apart, and an engaged position in which said teeth pass through said slot of said first finger and into said groove of said second finger.

* * * * *